US007389597B1

(12) United States Patent
Chen

(10) Patent No.: US 7,389,597 B1
(45) Date of Patent: Jun. 24, 2008

(54) STEAM IRON

(75) Inventor: Hsi-Fu Chen, Changhua County (TW)

(73) Assignee: Samson Tsen, Taipei (TW)

( * ) Notice: Subject to any disclaimer, the term of this patent is extended or adjusted under 35 U.S.C. 154(b) by 0 days.

(21) Appl. No.: 11/700,875

(22) Filed: Feb. 1, 2007

(51) Int. Cl.
*D06F 75/20* (2006.01)
*D06F 75/08* (2006.01)

(52) U.S. Cl. ..... 38/77.83

(58) Field of Classification Search ..... 38/77.8, 38/77.83, 77.6, 77.5, 77.7, 93, 77.1; 68/222; 251/211, 153
See application file for complete search history.

(56) References Cited

U.S. PATENT DOCUMENTS 3,130,507 A * 4/1964 Hoecker ..... 38/77.5
3,667,486 A * 6/1972 Cole et al. ..... 134/45
4,875,301 A * 10/1989 Adams ..... 38/14
5,279,054 A * 1/1994 Chasen ..... 38/77.7
6,009,645 A * 1/2000 Shimizu et al. ..... 38/77.5
6,678,973 B2 * 1/2004 de Mori ..... 38/77.6
6,935,056 B2 * 8/2005 Milanese ..... 38/77.5

FOREIGN PATENT DOCUMENTS

TW 319256 11/1997
TW M250728 U 11/2004
WO WO2005/059232 * 6/2005

* cited by examiner

*Primary Examiner*—Ismael Izaguirre
(74) *Attorney, Agent, or Firm*—Muncy, Geissler, Olds & Lowe, PLLC

(57) ABSTRACT

The present invention discloses as a steam that includes an iron casing, a first steam outlet, a second steam outlet, a heating member installing a water input portion and a steam output portion disposed at the iron casing, and a switch valve connected to the steam output portion and the first and second steam outlets. The switch valve having a switching routine for a first switch position and a second switch position is used for determining whether the steam heated by the steam output portion is outputted from the first steam outlet or the second steam outlet. The steam iron can provide both board-type and standing-type designs of steam irons and improve the value of the steam iron significantly.

11 Claims, 9 Drawing Sheets

STEAM IRON

FIELD OF THE INVENTION

The present invention relates to a steam iron, and more particularly to a steam iron with a design of having two types of steam outlets provided for both board-type ironing and standing-type ironing.

BACKGROUND OF THE INVENTION

Steam iron can be divided into two types: a board-type and a standing-type. The board-type iron is mainly used for ironing clothes, and its structure mainly includes a cold water storage portion, a vaporizer and an ironing plate, such that the cold water coming from the cold water storage portion is heated and vaporized by a vaporizer to produce steam, and the steam is discharged from a plurality of steam holes of the ironing plate. The structure of the standing-type steam iron is substantially the same as that of the board-type steam iron, but the major difference resides on that the standing-type steam iron includes a handheld ironing portion with steam holes, such that the discharged high-temperature steam can be used for ironing clothes, as well as cleaning clothes and removing smells.

The aforementioned two steam irons require processes of heating and vaporizing cold water into water vapors, and then using the steam for ironing or cleaning clothes, and thus the vaporization effect directly affects the performance of the steam irons. Water in a liquid state will be vaporized when the water is heated to a vaporization temperature, but the water is coexisted in both liquid and gaseous states, which is called "wet steam", and the wet steam is at situated at an unstable state. Particularly, if the temperature drops during the process of transmitting the steam, the steam will be condensed into water at a liquid state to make the clothes wet. If the temperature continues rising and exceeds the vaporization temperature, the water at a liquid state is vaporized into steam, which is called "dry steam", and the dry steam will not wet the clothes easily due to a drop of temperature.

To use dry steam for cleaning or ironing clothes by a steam iron, a steam washer and vaporizer structure as disclosed in R.O.C. Utility Model Patent No. M250728 is provided for giving a better vaporization effect. The structure comprises a base, an upper casing and a water input device, wherein the water input device provides water at a liquid state to be entered from the vaporizer, and the base installs a plurality of isolating pillars and a U-shape water passage to define a closed space after the upper casing is combined with the base, and an isolating pillar increases the contact area with the liquid water, and the U-shape water passage increases the time of heating the liquid water, such that the water at a liquid state can be heated sufficiently to form dry steam. In another conventional structure for increasing and storing the temperature for the steam in a steam chamber of a steam iron as disclosed in R.O.C. Utility Model Patent Publication No. 319256, an appropriate quantity of erected fins are installed in the steam chamber to achieve the effects of increasing the temperature of the steam and storing the steam, but the vaporizers of the foregoing two steam irons or devices still cause a temperature drop of steam while transmitting steam, so that the dry steam will be condensed into the wet steam.

At present, steam is used for ironing and cleaning clothes, and it is necessary to use a board-type steam iron or a standing-type steam iron, since the board-type steam iron can iron clothes better, but the quantity of steam is scattered and all components are concentrated at the single iron, and thus it cannot be applied to the hanging clothes due to its weight. On the other hand, the standing-type steam iron discharges steam at a spot and thus it cannot be applied for ironing different kinds of clothes, and thus causing inconvenience to users.

SUMMARY OF THE INVENTION

It is a primary objective of the present invention to provide a board-type design and a standing-type design of a steam device, and the steam iron of the invention comprises an iron casing, a heating member and a switch valve. The iron casing includes an upper casing and a bottom plate connected to the upper casing, an installation space defined in the iron casing for installing the heating member, at least one first steam outlet and one second steam outlet disposed on the iron casing and serving as steam outlets. The heating member includes a water input portion and a steam output portion, and the switch valve having a switching routine between a first switch position and a second switch position is used for determining whether to use the first steam outlet or the second steam outlet to output the heated steam coming from the steam output portion.

Another objective of the present invention is to form a steam chamber by a heating member and a bottom plate, and the heating member is disposed at the bottom of the second steam chamber having a second heat conducting structure, and the second heat conducting structure can heat the steam coming from the first steam chamber and maintain the temperature of steam in the second steam chamber, so as to achieve an even temperature at the bottom plate by the contact with the bottom plate.

DETAILED DESCRIPTION OF THE PREFERRED EMBODIMENTS

The present invention will now be described in more detail hereinafter with reference to the accompanying drawings that show various embodiments of the invention.

Figure 1:
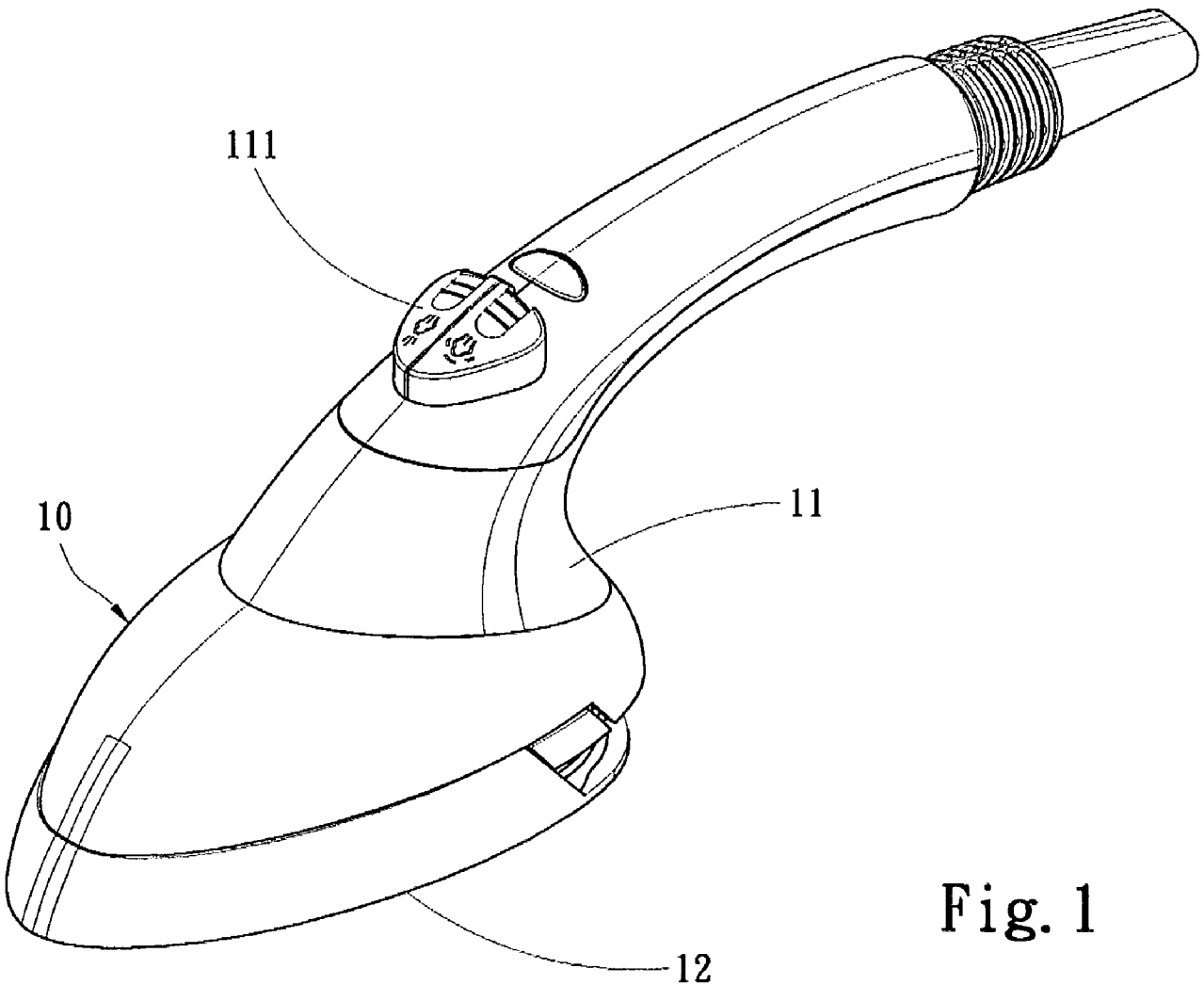
FIG. 1 is a perspective view of a steam iron of the present invention.
Figure 2:
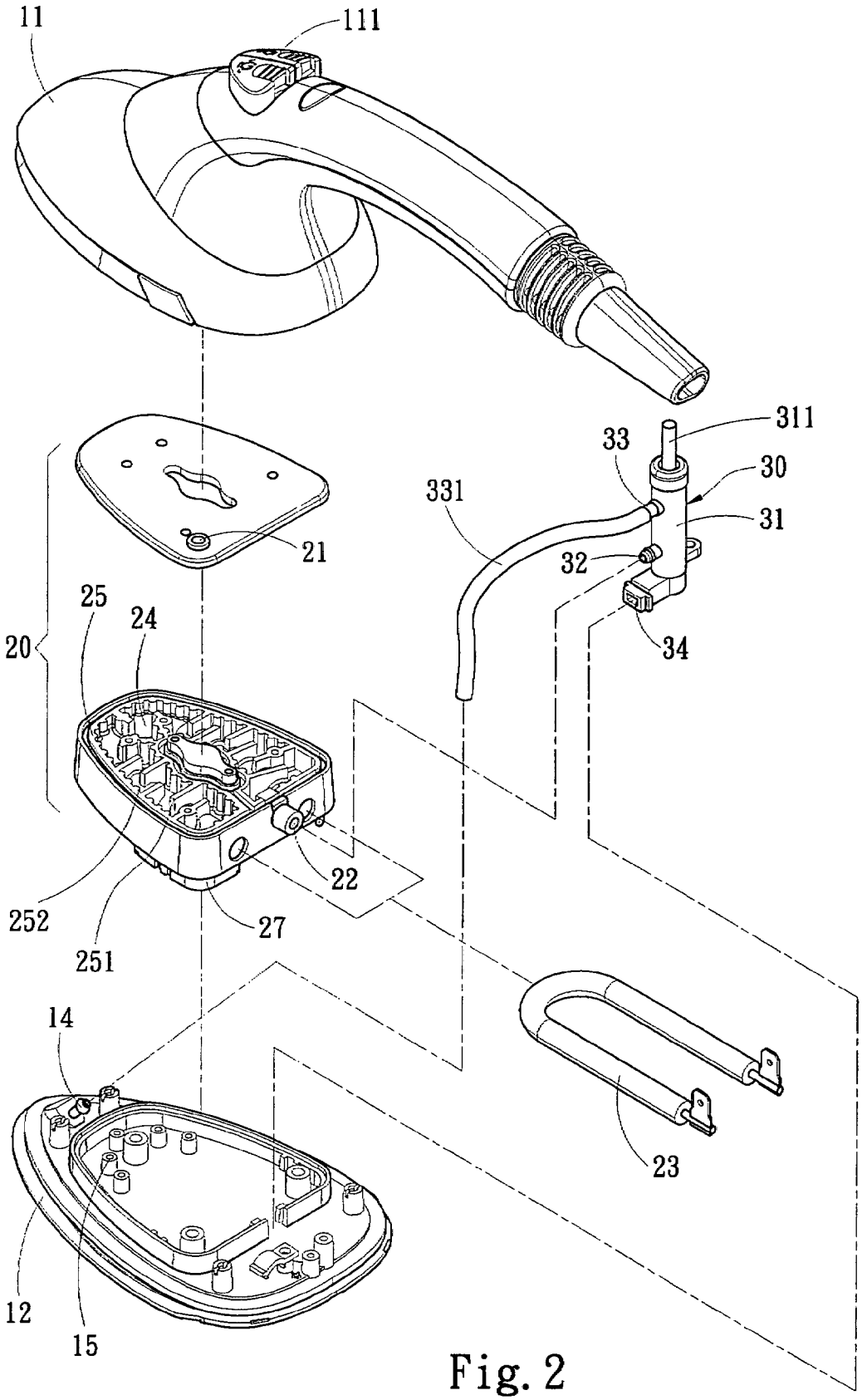
FIGS. 2 and 3 for exploded views of a steam iron of the present invention.
Figure 3:
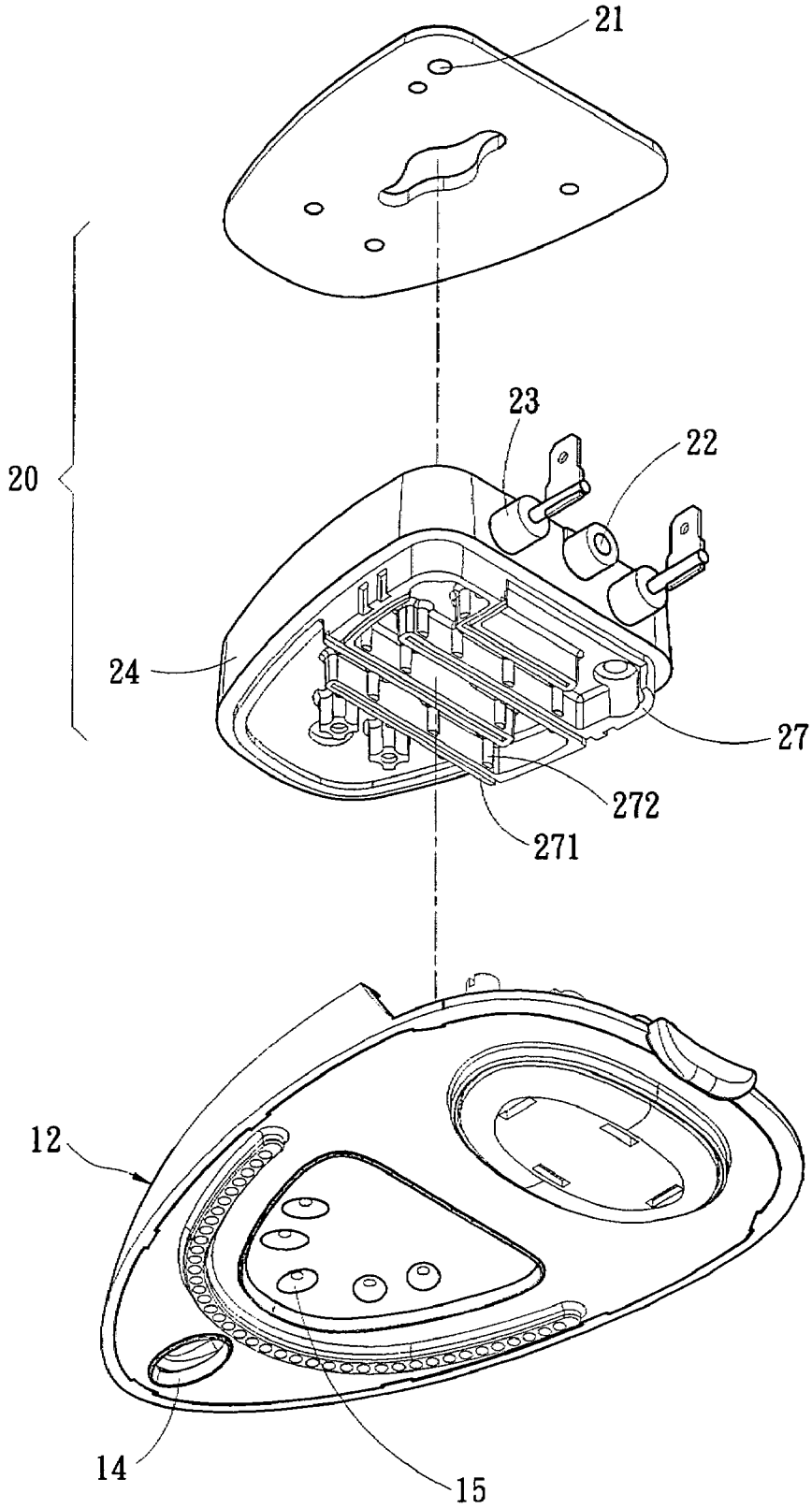

Referring to FIGS. 1 to 3 for a perspective view, and exploded views of a steam iron of the present invention respectively, the steam iron comprises an iron casing 10, and the iron casing 10 comprises an upper casing 11 and a bottom plate 12 coupled to the upper casing 11, such that the bottom plate 12 and the upper casing 11 constitute at least one installation space 13 inside an iron casing 10 (or each of the upper casing 11 and bottom plate 12 forms a separate installation space 13, and the iron casing 10 has a first steam outlet 14 and a second steam outlet 15, and the installation space 13 includes a heating member 20, and the heating member 20 includes a water input portion 21 and a steam output portion 22 interconnected with each other, and the steam iron has a switch valve 30 for connecting the steam output portion 22 and the first and second steam outlets 14, 15, and the switch valve 30 at least includes a switching routine for a first switch position 301 and a second switch position 302 to determine whether the heated steam 41 produced by the steam output portion 22 is discharged from the first steam outlet 14 or the second steam outlet 15.

Figure 4A:
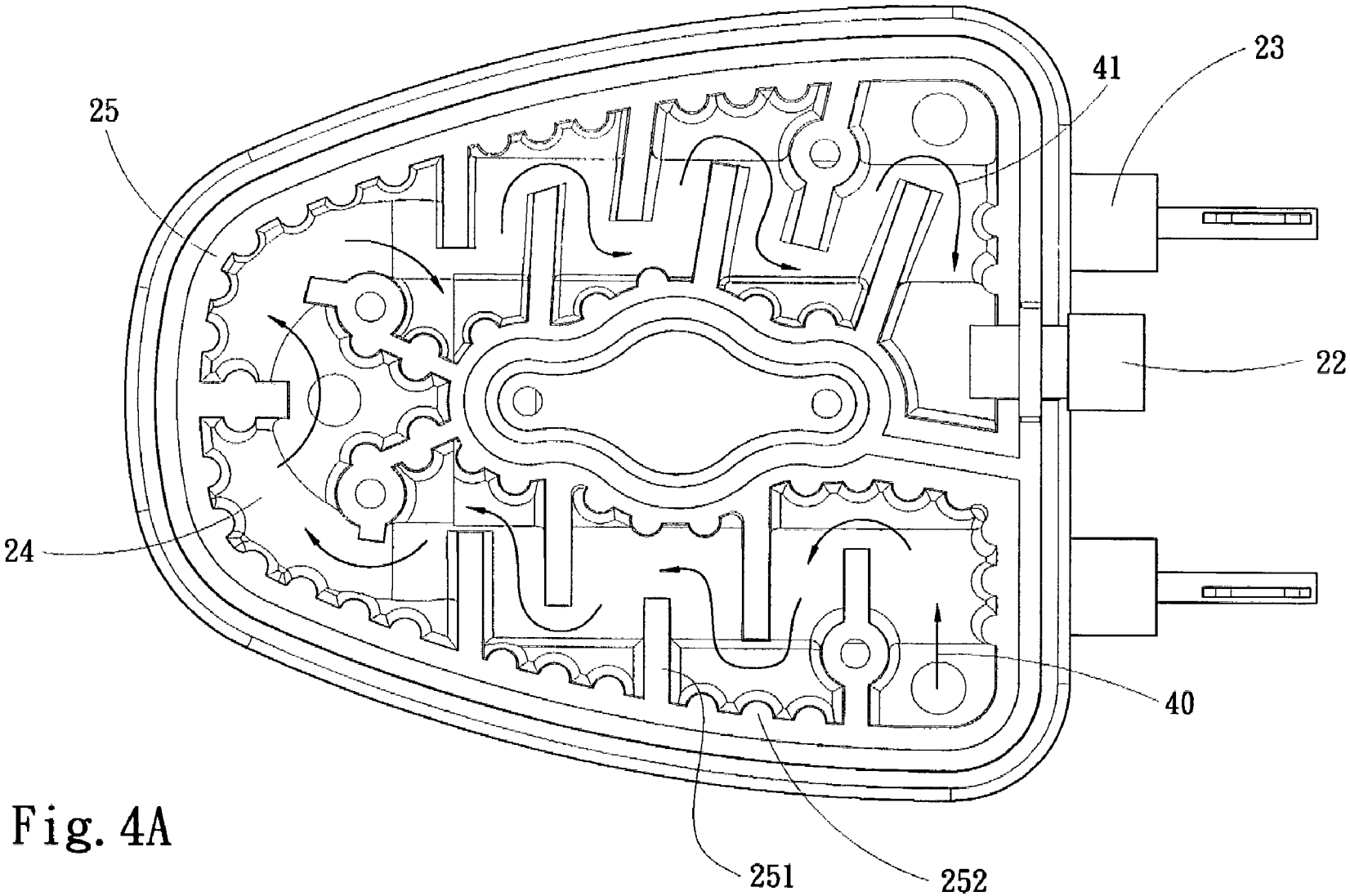
FIG. 4A is a schematic view of a steam flow produced by a heating member of the present invention.

Referring to FIG. 4A, the way for the heating member 20 to heat the steam 41 is to install an electric heating pipe 23 electrically coupled to an external power supply that is installed on the heating member 20, and the interconnected section of the water input portion 21 of the heating member 20 (wherein the water input portion can be installed outside or inside the steam iron, depending on the overall weight, which is not a technical characteristic of the present invention, and thus will not be described here) and the steam output portion 22 define a first steam chamber 24, and the first steam chamber 24 has a first heat conducting structure 25, and the first heat conducting structure 25 includes a protrusion 251 disposed on an internal wall of the heating member 20 and a protruding board 252 arranged and partitioned at the first steam chamber 24, such that the first heat conducting structure 25 can be used for increasing the heating time and the heating area of the cold water 40 entered from the water input portion 21, so as to expedite the production of steam 41 and ensure the production of dry steam 41.

Figure 5A:
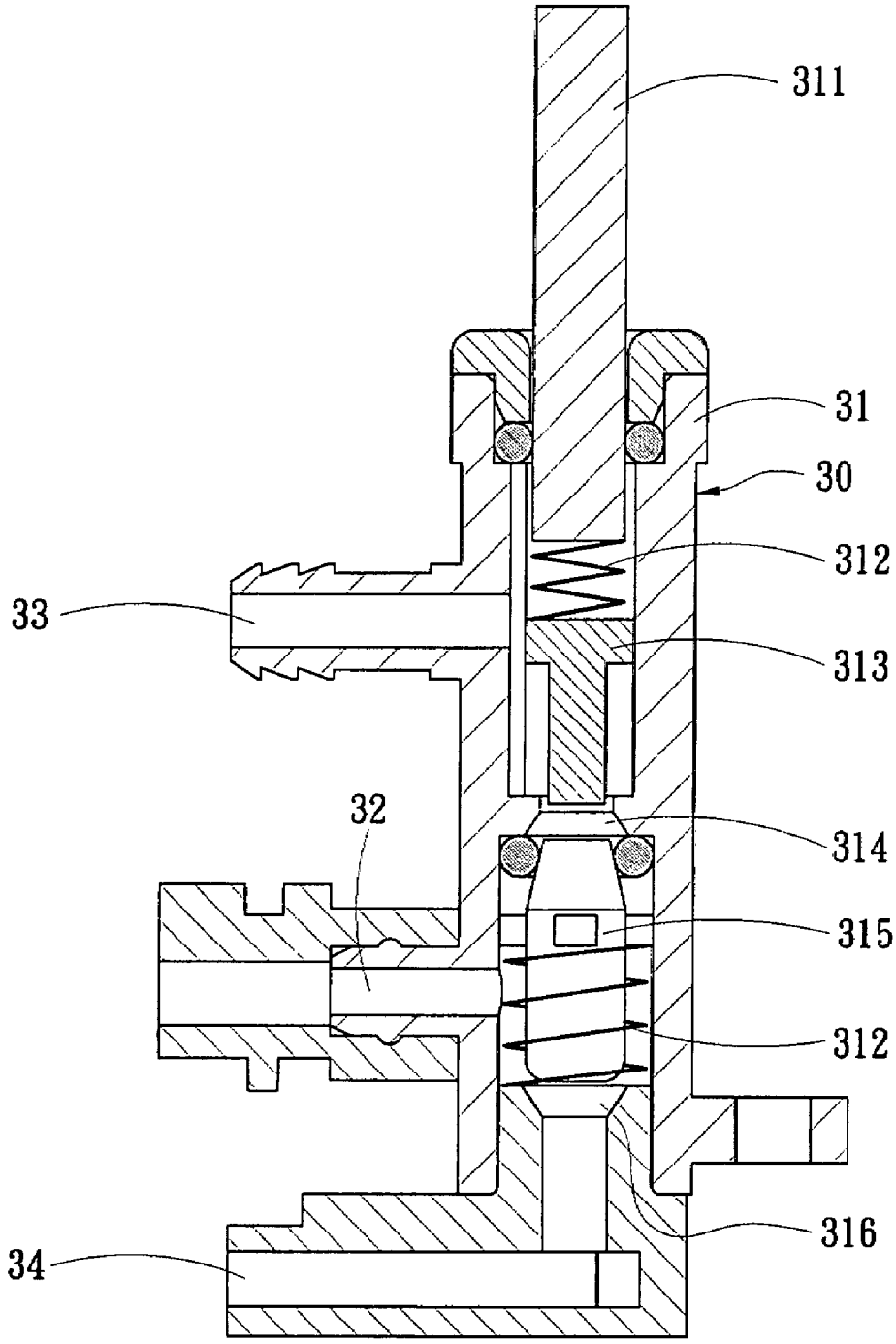
FIGS. 5A and 5B are schematic views of a steam output of a switch valve at a first switch position of the present invention.

Referring to FIG. 5A, the iron casing 10 includes a switch valve 30 exerted by a force for pressing a switch button 111 (which is a double-switch button 111 in this embodiment, and the invention is not limited to such arrangement only, but a single-switch button 111 can be used as well) for performing a switching routine. The switch valve 30 comprises a switch body 31 connected to the switch button 111, at least one steam input portion 32 disposed on the switch valve 30 and connected to the steam output portion 22, and two steam output portions 33, 34 interconnected to the steam input portion 32 and the first and second steam outlets 14, 15 respectively, and the first steam output portion 33 is connected to the first steam outlet 14 by a steam duct 331, and the switch body 31 contains at least one switch member 311 and isolating members 313, 315, for switching the switch button 111 pressed by the switch member 311 and driven by the isolating member 313, 315 to a first switch position 301 and a second switch position 302. The isolating members 313, 315 install a resilient element 312 for storing and releasing the resilience to drive the switch valve 30 to perform the switching routine. The switch valve 30 is installed inside or outside the iron casing 10 depending on the size of the installation space 13 of the iron casing 10, but the invention is not limited to such arrangement.

Figure 5B:
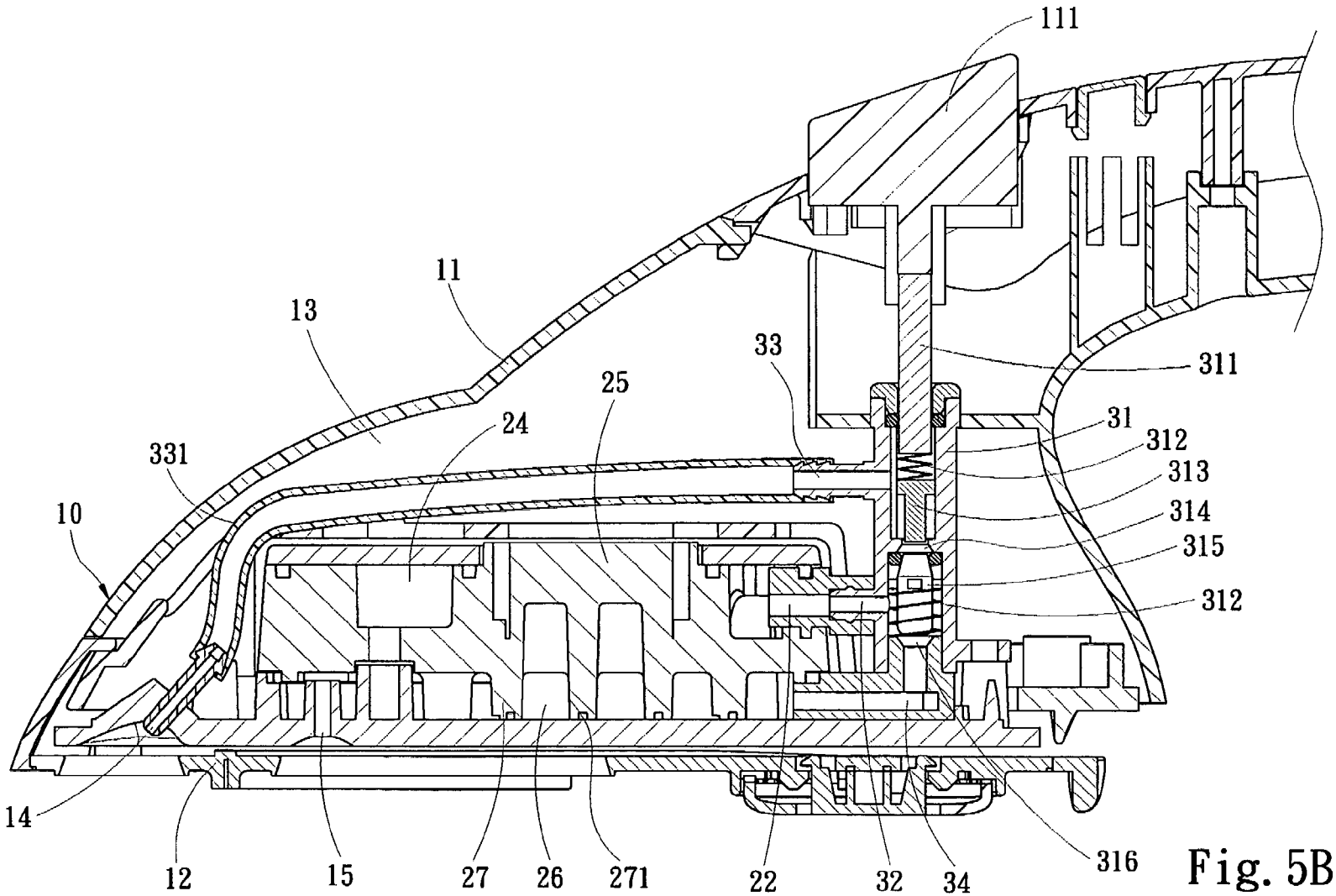

Referring to FIG. 5B, external cold water 40 is passed through the water input portion 21 and entered into the heating member 20, if the switch button 111 is switched to the first switch position 301. The cold water 40 forms the steam 41 as described in a previous section and illustrated in FIG. 4A, and then passes through the steam output portion 22 and enters into the switch valve 30. Since the second isolating member 315 is supported by the resilient element 312 to seal the first air hole passage 314 and block the steam 41 from passing through the first steam output portion 33, therefore the steam 41 is passed through the second air hole passage 316 to the second steam output portion 34 instead.

Figure 4B:
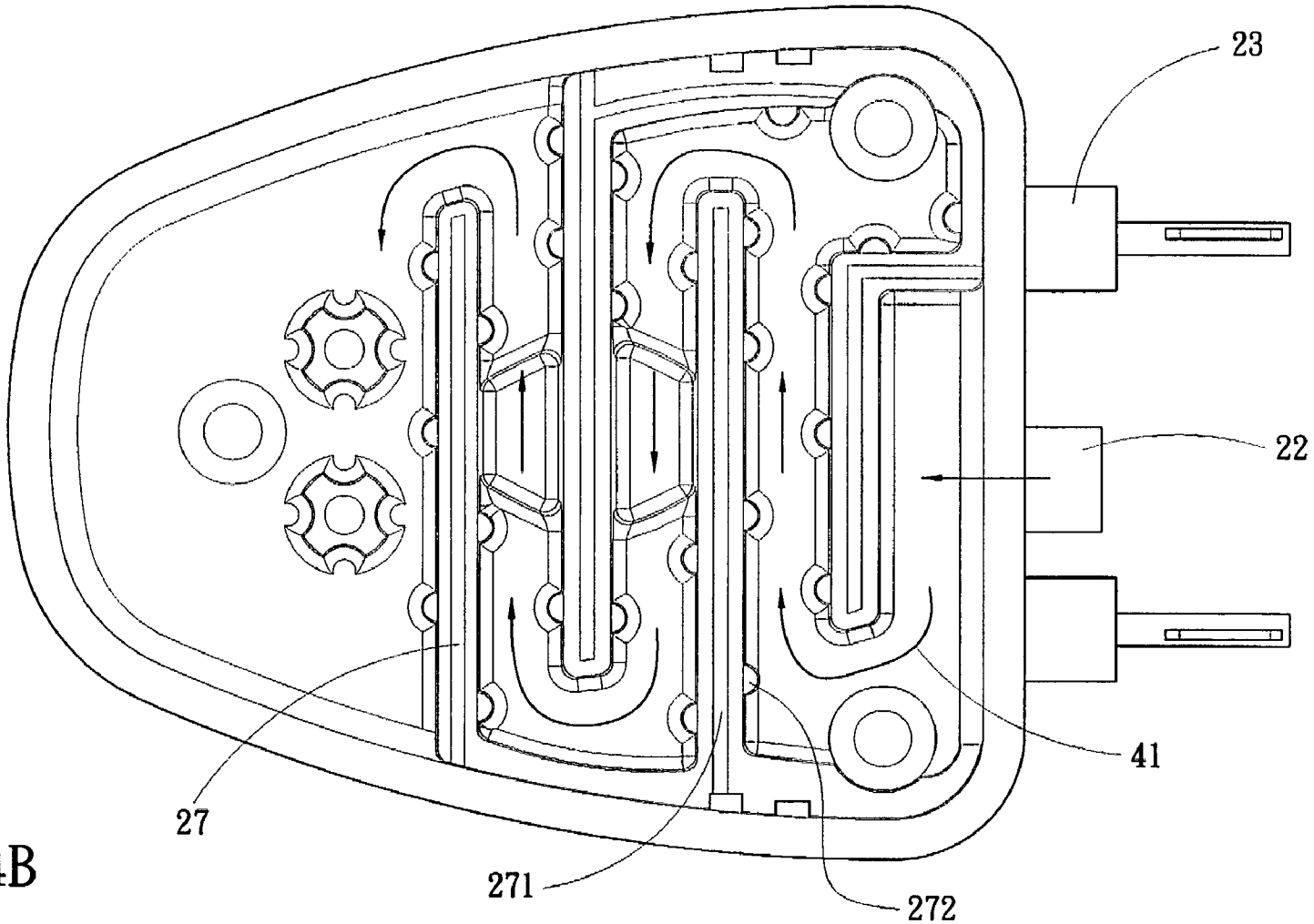
FIG. 4B is a schematic view of a steam flow direction of a second steam chamber of the present invention.

The heating member 20 and the bottom plate 12 constitute a second steam chamber 26 as shown in FIG. 4B. Similarly, the heating member 20 of the present invention disposed at the bottom of the second steam chamber 26 having a second heat conducting structure 27, and the second heat conducting structure 27 forms a steam passage 272 in the second steam chamber 26 by a heat conducting partition 271. The heat conducting partition 271 can be extended to be in contact with the bottom plate 12 for controlling the bottom plate 12 at a uniform temperature. In addition, the heat conducting partition 27 also includes a plurality of protrusions 251 to increase the contact surface with the steam 41, such that the steam 41 passing through the second heat conducting structure 27 can be maintained at existing conditions including the temperature and the dryness of the steam, and the steam 41 passing through the second steam chamber 26 is outputted from the second steam outlet 15 situated at the bottom plate 12.

Figure 6A:
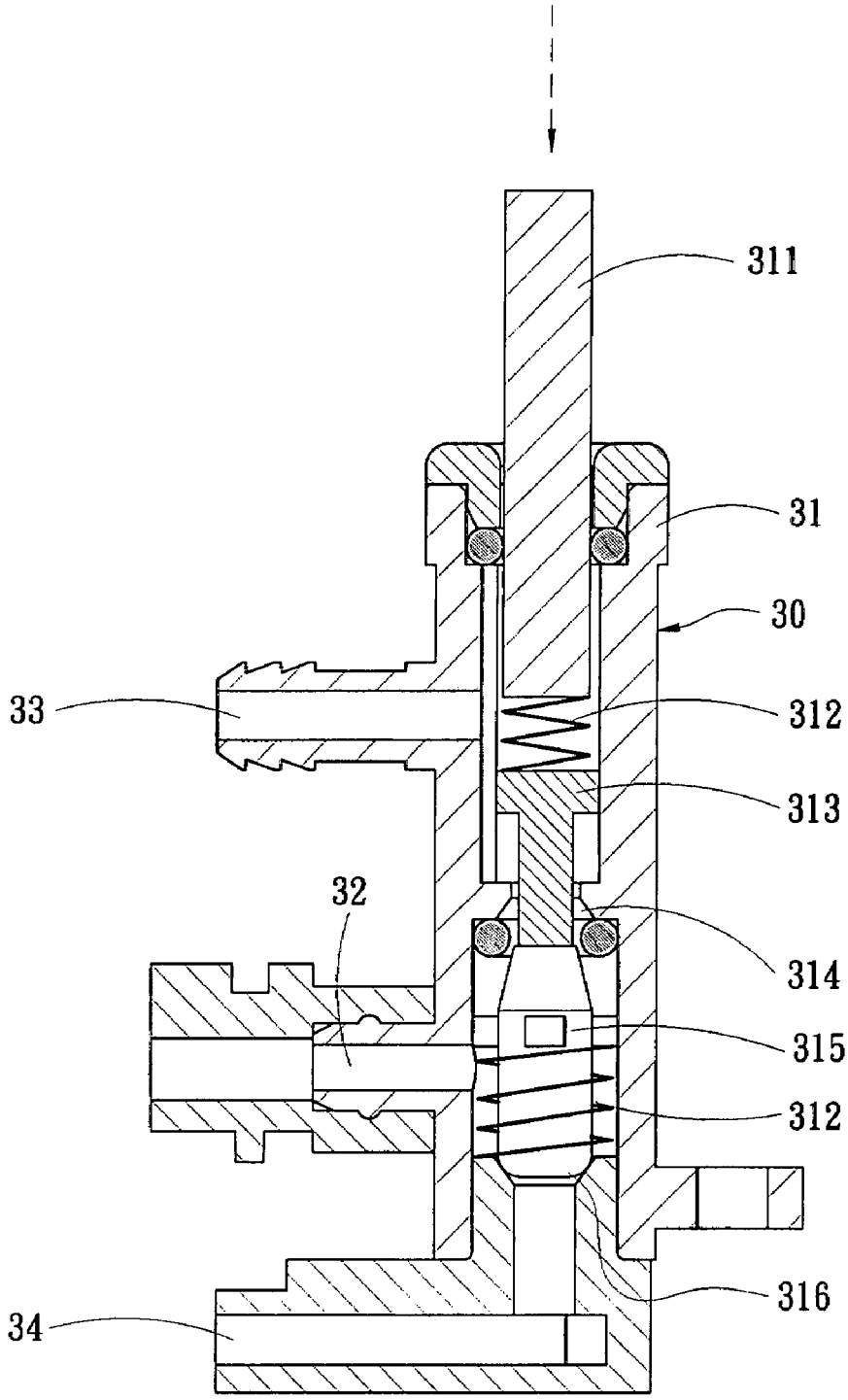
FIGS. 6A and 6B are schematic views of a steam output of a switch valve at a second switch position of the present invention.
Figure 6B:
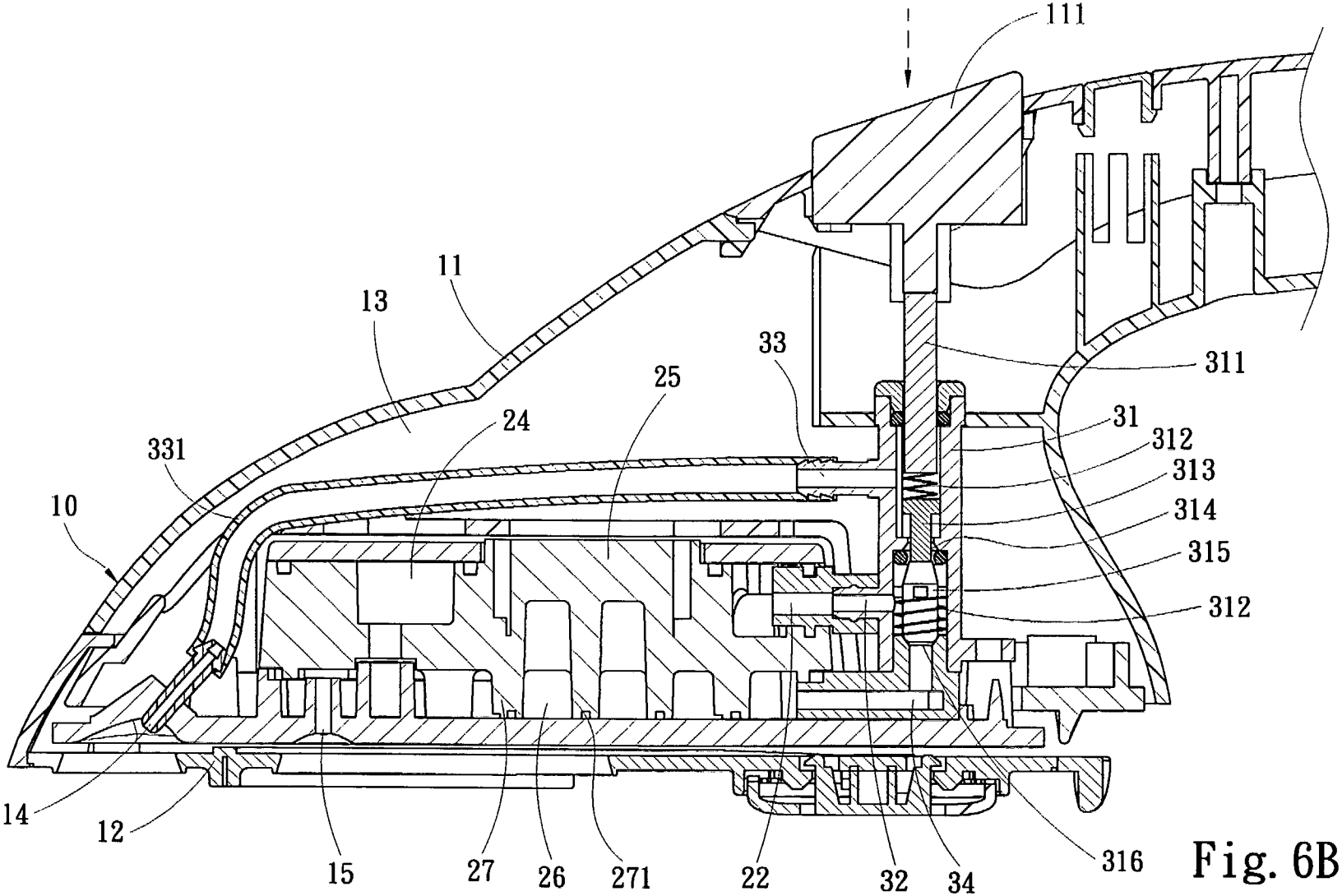

Referring to FIGS. 6A and 6B for schematic views of a steam output of a switch valve at a second switch position of the present invention, the resilient element 312, first isolating member 313 and second isolating member 315 move downward, after the switch member 311 is pressed by the switch button 111 at the second switch position 302, and the second isolating member 315 seals the second ventilation air hole passage 316 and blocks the steam 41 passing to the second steam output portion 34, and thus the steam 41 changes its flowing direction towards the first air hole passage 314 and is passed to the first steam output portion 33, and then through the steam duct 331 to the first steam outlet 14, and the first steam outlet 14 can be installed at the bottom plate 12 or any other appropriate position on the iron casing 10.

In summation of the description above, the present invention adopts the design of a single switch valve 30 installed on the iron casing 10 and having at least two sets of steam output holes 14, 15, and thus designers have to define the first steam outlet 14 in the same way as a general board-type steam iron with the design of a multiple of steam holes for ironing clothes, and the second steam hole 15 can be designed for discharging a large quantity of steam 41 similar to the single hole design of the standing-type steam iron, so as to constitute a steam iron having both board-type and standing-type design, and increases the value of the steam iron significantly.

While the invention has been described by means of specific embodiments, numerous modifications and variations could be made thereto by those skilled in the art without departing from the scope and spirit of the invention set forth in the claims.

What is claimed is:

1. A steam iron, comprising:

an iron casing, including an upper casing, a bottom plate coupled to said upper casing, at least one installation space defined in said iron casing, and a first steam outlet and a second steam outlet, both being disposed on said iron casing;

a heating member, installed in said installation space, and having a water input portion and a steam output portion interconnected with said water input portion, and both being disposed on said heating member;

a switch valve, for connecting said steam output portion with said first and second steam outlets, and said switch valve comprising a switching routine between a first switch position and a second switch position to determine a heated steam coming from said steam output portion to be outputted from said first steam outlet or said second steam outlet;

said heating member defining a first steam chamber by an interconnect section of said water input portion and said steam output portion, and said steam chamber includes a first heat conducting structure for improving a steam output;

said heating member and said bottom plate constituting a second steam chamber, said second steam outlet being disposed on said bottom plate in said second steam chamber.

2. The steam iron of claim 1, wherein said iron casing has a switch button which can be exerted by a force and pressed to carry out a switching routine for said switch valve.

3. The steam iron of claim 1, wherein said heating member includes an electric heating pipe electrically coupled to said external power supply.

4. The steam iron of claim 1, wherein said first heat conducting structure includes a protrusion disposed on an internal wall of said heating member, and a protruding board disposed and partitioned at said first steam chamber.

5. The steam iron of claim 1, wherein said heating member is disposed at the bottom of said second steam chamber, and has a second heat conducting structure.

6. The steam iron of claim 5, wherein said second heat conducting structure forms a steam passage in said second steam chamber by a heat conducting partition.

7. The steam iron of claim 6, wherein said heat conducting partition is extended to be in contact with said bottom plate.

8. The steam iron of claim 1, wherein said first steam outlet is disposed on said bottom plate.

9. The steam iron of claim 1, wherein said switch valve is coupled to said first steam outlet by a steam duct.

10. The steam iron of claim 1, wherein said switch valve includes a switch body, and said switch body comprises a steam input portion connected to said steam output portion, two steam output portions interconnected with said steam input portion and connected to said first and second steam outlets respectively, at least one switch member disposed in said switch body, and an isolating member driven by said switch member, such that said switch valve can be switched between said first switch position and said second switch position.

11. The steam iron of claim 10, wherein said switch member installs a resilient element for storing and releasing the resilience to carry out said switching routine of said switch member.

* * * * *